US005782385A

United States Patent [19]

Soon

[11] Patent Number: 5,782,385

[45] Date of Patent: Jul. 21, 1998

[54] TUBE SQUEEZER

[76] Inventor: Min Tet Soon. P.O. Box A-499, Sabah, Malaysia, 89357

[21] Appl. No.: 851,217

[22] Filed: May 5, 1997

[51] Int. Cl.[6] ..... B65D 35/28

[52] U.S. Cl. ..... 222/103

[58] Field of Search ..... 222/95, 103, 1; 206/277

[56] References Cited

U.S. PATENT DOCUMENTS

| | | | |
|---|---|---|---|
| D. 335,991 | 6/1993 | Roberts et al. | D6/541 |
| D. 341,050 | 11/1993 | Wafeensmith | D6/541 |
| D. 351,521 | 10/1994 | Knight, III | D6/541 |
| 4,159,787 | 7/1979 | Wright | 222/103 |
| 4,502,613 | 3/1985 | Yamamoto | 222/103 |
| 5,248,065 | 9/1993 | Zima | 222/103 |
| 5,330,077 | 7/1994 | Swanson | 222/95 |
| 5,442,839 | 8/1995 | Miller | 24/563 |

FOREIGN PATENT DOCUMENTS

| | | | |
|---|---|---|---|
| 2550955 | 5/1977 | Germany | 222/103 |

*Primary Examiner*—Philippe Derakshani
*Attorney, Agent, or Firm*—Richard L. Miller, P.E.

[57] ABSTRACT

A tube squeezer that is replaceably attachable to a tube with contents and prevents the contents of the tube from flowing backwards therein when the tube is no longer squeezed and thereby allowing the contents of the tube to be readily and constantly available without waste. The squeezer includes a lower portion and an upper portion. The lower portion has two pair of vertically-disposed legs with inboard surfaces that oppose each other and define a longitudinal space therebetween. The lower portion further has a lateral space between each pair of legs at the pair of lateral sides of the lower portion. The top surface of the lower portion has a groove. The upper portion is replaceably interlocked with the lower portion. The upper portion further has a pair of tabs, each of which releasibly and frictionally engages its respective lateral space in the lower portion when the upper portion is interlocked with the lower portion. The bottom surface of the upper portion has a pair of longitudinally-disposed tabs, each of which releasibly and frictionally engages its respective longitudinal space in the lower portion when the upper portion is interlocked with the lower portion, and terminates in ends that releasably and frictionally engage the inboard surfaces of the two pair of legs of the lower portion when the upper portion is interlocked with the lower portion.

19 Claims, 1 Drawing Sheet

FIG. 1
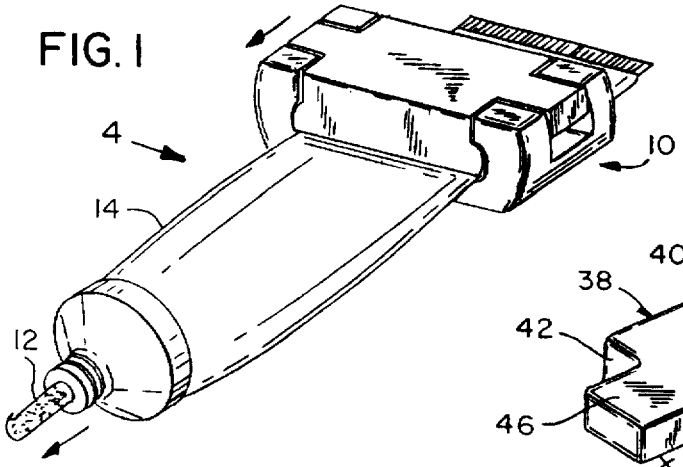
FIG. 2
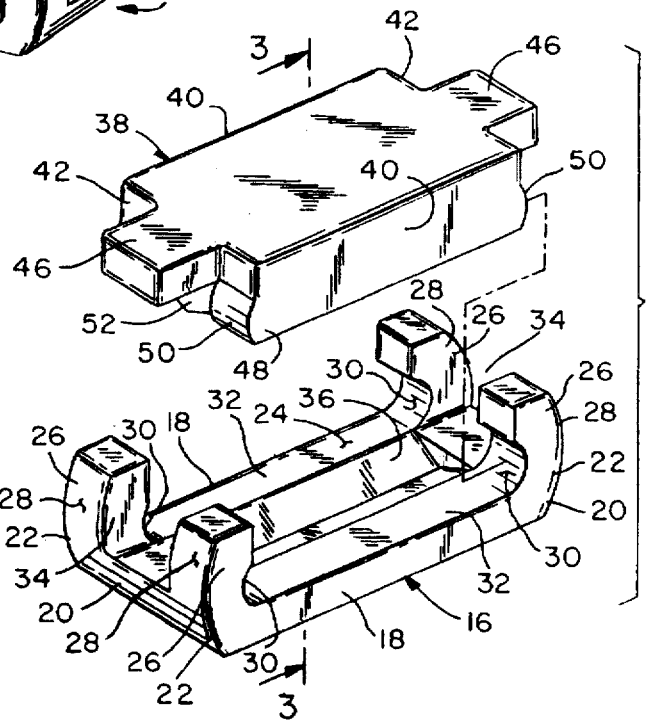
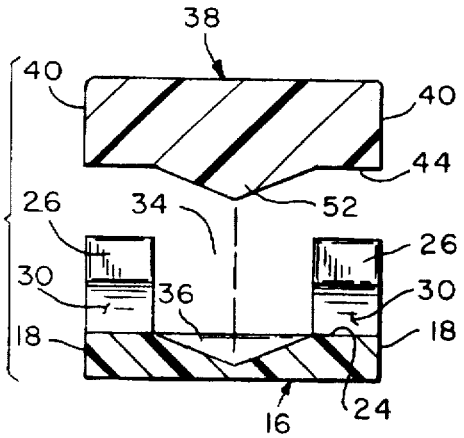
FIG. 3
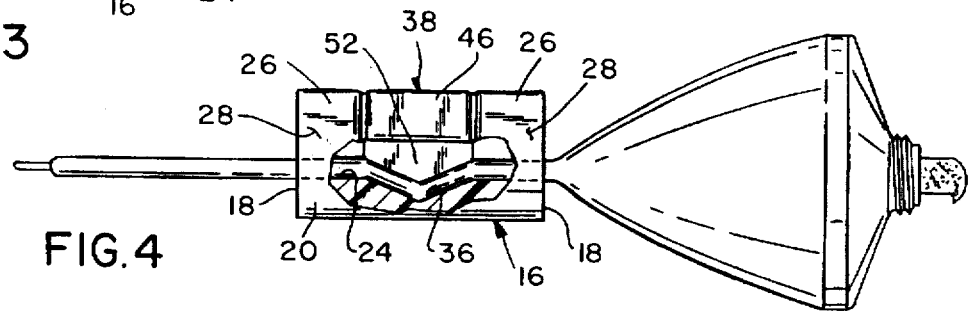
FIG. 4
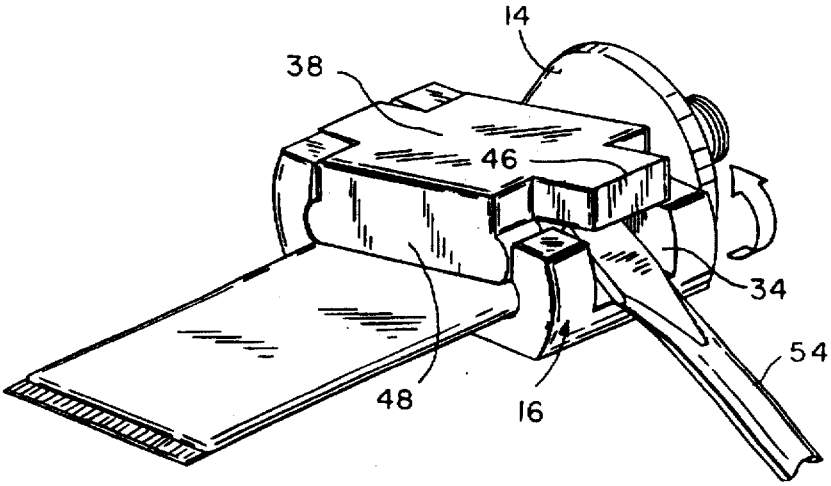
FIG. 5

TUBE SQUEEZER

BACKGROUND OF THE INVENTION

The present invention relates to a tube squeezer. More particularly, the present invention relates to a tube squeezer that is replaceably attachable to a tube with contents and prevents the contents of the tube from flowing backwards therein when the tube is no longer squeezed and thereby allowing the contents of the tube to be readily and constantly available without waste.

It is known that as one continually squeezes a tube for squeezing out its contents, it becomes more difficult to do so owing to the fact that some of the contents of the tube are squeezed toward the end of the tube away from the dispensing opening. This also causes some of the contents to be wasted, since one does not attempt to squeezes residue of the contents remaining at the end of the tube when much of the tube contents has been dispensed. Typically, one must roll up the end of the tube over time, as the contents are dispensed, in order to prevent the contents from flowing backward to the closed end of the tube.

Most toothpaste tubes are currently made of plastic. Heretofore, tubes were made of metal foil and were subject to tearing or being perforated, resulting in paste or cream issuing from the hole formed by the tear or perforation. The unsealable hole enabled air to reach the paste or cream so that it would dry and cake. Metal foil tubes were thus unsatisfactory and plastic tubes gained rapid public acceptance.

In one respect, however, metal tubes were superior to plastic tubes. Metal tubes did not have the "memory" that plastic tubes have. Memory is a characteristic of materials that is related to resilience. A material with memory will, after stress has been relieved, tend to restore itself to a configuration the material was before the stress was applied. A plastic tube if coiled will tend to uncoil whereas a metal foil tube will much more readily remain coiled.

For reasons of economy, many people prefer to exhaust the supply of toothpaste in a tube before discarding it. Removing the toothpaste from a plastic tube is, to some extent, much easier than removing the toothpaste from a metal foil tube because the plastic tube can be subjected to squeezing without concern for perforations and tearing.

After squeezing the tube from the bottom end to the cap, the tube should be coiled to prevent the toothpaste from migrating away from the cap end of the tube. The tendency of a plastic tube to uncoil and straighten, however, enables the toothpaste to migrate. A straightened tube encourages some people to squeeze the tube from the middle or top, near the cap, rather than from the bottom where they should if they want to force the toothpaste in the tube towards the cap. Finally, a partially spent toothpaste tube, with the squeezing marks on it, is not very neat looking.

Numerous innovations for toothpaste tube squeezers have been provided in the prior art that will be described. Even though these innovations may be suitable for the specific individual purposes to which they address, however, they differ from the present invention.

FOR EXAMPLE, U.S. Pat. No. Des. 335,991 to Roberts et al. teaches the ornamental design for a toothpaste tube squeezer.

ANOTHER EXAMPLE, U.S. Pat. No. Des. 341,050 to Waffensmith teaches the ornamental design for a toothpaste tube squeezer.

STILL ANOTHER EXAMPLE, U.S. Pat. No. Des. 351,521 to Knight, III teaches the ornamental design for a toothpaste tube squeezer.

YET ANOTHER EXAMPLE, U.S. Pat. No. 5,248,065 to Zima teaches a device for squeezing out the contents of a tube, such as toothpaste. There is provided a flat, lower frame upon which supports a squeezable tube whose contents are to be dispensed. Extending upwardly from the top, flat surface of the frame are two pairs of two guide-posts. The two pairs of guide-posts are aligned and are spaced apart along the length of the top surface of the frame. The two-guide posts of each pair are laterally spaced apart, whereby a tube may be inserted on the top surface and between the upstanding posts of the pairs of guide-posts. Mounted for manual, vertical movement along the two pairs of guide-posts are a pair of spaced-apart slide-blocks, one such slide-block for one such pair of guide-posts. Each slide-block has a pair of oppositely-disposed through-holes through which pass the two guide-posts of the respective pair. Both slide-blocks are used during the dispensing of the contents of a tube positioned on the top surface of the frame, between the guide-posts. One slide-block is used for squeezing out the contents of the tube through the dispensing mouth, by pressing down on the tube. The other slide-block prevents the contents from being squeezed toward the closed end of the tube as the first slide-block is pushed downwardly to dispense through the open mouth.

FINALLY, STILL YET ANOTHER EXAMPLE, U.S. Pat. No. 5,442,839 to Miller teaches a clip for controlling a toothpaste tube when the end of the tube is folded into flattened coil. The clip is made of a resilient material and comprises an integrally attached front and back member. The front member terminates in an inwardly depending lip which, when engaging the edge of a fold made in the emptied part of the tube, prevents the coil from unfolding and the tube from slipping from the clip. The short lip near the open end of the clip holds the tube in the clip without having the clip clamp onto the tube. Thus, the clip opening can be large enough to enable the tube to be easily inserted. The back member flares outwardly, allowing the contents of the tube to be easily expressed therefrom.

It is apparent that numerous innovations for toothpaste tube squeezers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a tube squeezer that avoids the disadvantages of the prior art.

ANOTHER OBJECT of the present invention is to provide a tube squeezer that is simple and inexpensive to manufacture.

STILL ANOTHER OBJECT of the present invention is to provide a tube squeezer that is simple to use.

YET ANOTHER OBJECT of the present invention is to provide a tube squeezer that makes it easier to squeeze out the contents of the tube as no air is inside the tube STILL YET ANOTHER OBJECT of the present invention is to provide a tube squeezer that scrapes the contents of the tube from the tail towards the front part.

YET STILL ANOTHER OBJECT of the present invention is to provide a tube squeezer that maximizes the useful rate of the contents of the tube.

STILL YET ANOTHER OBJECT of the present invention is to provide a tube squeezer that makes the tube it is used on like new when being used.

YET STILL ANOTHER OBJECT of the present invention is to provide a tube squeezer that provides an indicator of the amount of contents left in the tube by its position on the tube, so that when it is close to the cap it is time to replace the tube.

STILL YET ANOTHER OBJECT of the present invention is to provide a tube squeezer that is reuseable.

BRIEFLY STATED, YET STILL ANOTHER OBJECT of the present invention is to provide a tube squeezer that is replaceably attachable to a tube with contents and prevents the contents of the tube from flowing backwards therein when the tube is no longer squeezed and thereby allowing the contents of the tube to be readily and constantly available without waste. The squeezer includes a lower portion and an upper portion. The lower portion has a pair of longitudinal sides, a pair of lateral sides that meet the pair of longitudinal sides of the lower portion at corners, a top surface, two pair of vertically-disposed legs with outboard surfaces and inboard surfaces. Each pair of legs of the two pair of legs of the lower portion extend vertically upwardly from a respective longitudinal side of the pair of longitudinal sides of the lower portion at a respective pair of corners of the corners of the lower portion. The inboard surfaces of each pair of legs of the two pair of legs of the lower portion oppose each other and define a longitudinal space therebetween. The lower portion further has a lateral space between each pair of legs of the pair of legs of the lower portion at the pair of lateral sides of the lower portion. The top surface of the lower portion has a groove that extends longitudinally therealong between the two pair of legs of the lower portion. The upper portion is replaceably interlocked with the lower portion and has a pair of longitudinal sides, a pair of lateral sides with centers, and a bottom surface. The upper portion further has a pair of tabs, each of which extends outwardly from a respective lateral side of the pair of lateral sides of the upper portion and releasibly and frictionally engages its respective lateral space in the lower portion when the upper portion is interlocked with the lower portion. The bottom surface of the upper portion has a pair of longitudinally-disposed tabs, each of which extends downwardly along a respective longitudinal side of the pair of longitudinal sides of the upper portion and releasibly and frictionally engages its respective longitudinal space in the lower portion when the upper portion is interlocked with the lower portion, and terminates in ends that releasibly and frictionally engage the inboard surfaces of the two pair of legs of the lower portion when the upper portion is interlocked with the lower portion. The bottom surface of the upper portion further has a projection that extends longitudinally therealong between the pair of longitudinally-disposed tabs on the bottom surface of the upper portion, and cooperatively engages the groove in the top surface of the lower portion when the upper portion is interlocked with the lower portion, so that when the tube is positioned through the longitudinal spaces in the lower portion, transversely across the groove in the top surface of the shaped lower portion, and the ends of the pair of longitudinally-disposed tabs of the bottom surface of the upper portion frictionally engage the inboard surfaces of the two pair of legs of the lower portion, and the pair of longitudinally-disposed tabs of the bottom surface of the upper portion frictionally engage the longitudinal spaces in the lower portion, and the pair of tabs of the upper portion frictionally engage the lateral spaces in the lower portion, the projection on the bottom surface of the upper portion compresses and deforms the tube downwardly into the groove in the top surface of the lower portion where it is maintained and the contents in the tube is prevented from flowing backward therefrom when the tube is no longer squeezed and thereby allowing the contents of the tube to be readily available without waste, and as the contents of the tube is being used, the tube squeezer being slid forwardly along the tube, so that the contents in the tube is constantly available without waste.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention installed on a typical tube;

FIG. 2 is an enlarged exploded diagrammatic perspective view of the present invention;

FIG. 3 is an enlarged cross sectional view taken on line 3—3 in FIG. 2;

FIG. 4 is a diagrammatic side elevational view taken in the direction of arrow 4 in FIG. 1, with parts broken away; and FIG. 5 is a diagrammatic perspective view of the present invention being removed from the typical tube.

LIST OF REFERENCE NUMERALS UTILIZED IN THE DRAWING

10 tube squeezer of the present invention

12 tube contents

14 tube

16 slightly resilient and generally rectangular-shaped lower portion

18 lower portion pair of longitudinal sides

20 lower portion pair of convex-arcuate-shaped lateral sides

22 lower portion corners

24 lower portion top surface

26 lower portion two pair of opposing, generally convexo-concave shaped and vertically-disposed legs

28 lower portion legs convex-shaped outboard surfaces

30 lower portion legs concave-shaped inboard surfaces

32 lower portion longitudinal space

34 lower portion lateral space

36 a lower portion top surface longitudinally-disposed and V-shaped cross-sectioned groove

38 slightly resilient and generally rectangular-shaped upper portion

40 upper portion pair of longitudinal sides

42 upper portion pair of lateral sides

44 upper portion bottom surface

46 upper portion pair of rectangular-parallelepiped-shaped tabs

48 upper portion pair of longitudinally-disposed tabs

50 upper portion tab convex-arcuate-shaped ends

52 upper portion bottom surface longitudinally-disposed and V-shaped cross-sectioned projection

54 screw driver

DETAILED DESCRIPTION OF THE PREFERRED EMBODIMENT

Referring now to the figures in which like parts indicate like parts, and particularly to FIG. 1, which is a diagrammatic perspective view of the present invention installed on a typical tube, the tube squeezer of the present invention is shown generally at 10 installed on, and squeezing tube contents 12, from a tube 14.

The configuration of the tube squeezer 10 and its interaction with the tube 14 can best be seen in FIGS. 2–4, which are an enlarged exploded diagrammatic perspective view of the present invention, an enlarged cross sectional view taken on line 3—3 in FIG. 2, and a diagrammatic side elevational view taken in the direction of arrow 4 in FIG. 1, with parts broken away, respectively, and as such will be discussed with reference thereto.

The tube squeezer 10 includes a slightly resilient and generally rectangular-shaped lower portion 16 that has a lower portion pair of longitudinal sides 18, a lower portion pair of convex-arcuate-shaped lateral sides 20 that meet the lower portion pair of longitudinal sides 18 of the slightly resilient and generally rectangular-shaped lower portion 16 at lower portion corners 22, and a lower portion top surface 24.

The slightly resilient and generally rectangular-shaped lower portion 16 further has a lower portion two pair of opposing, generally convexo-concave shaped and vertically-disposed legs 26 with lower portion legs convex-shaped outboard surfaces 28 and lower portion legs concave-shaped inboard surfaces 30.

Each pair of legs of the lower portion two pair of opposing, generally convexo-concave shaped and vertically-disposed legs 26 of the slightly resilient generally rectangular-shaped lower portion 16 extend vertically upwardly from a respective longitudinal side of the lower portion pair of longitudinal sides 18 of the slightly resilient generally rectangular-shaped lower portion 16, at a respective pair of corners of the lower portion corners 22 of the slightly resilient and generally rectangular-shaped lower portion 16, with the lower portion legs convex-shaped outboard surfaces 28 of the lower portion two pair of opposing, generally convexo-concave shaped and vertically-disposed legs 26 of the slightly resilient and generally rectangular-shaped lower portion 16 extending smoothly upwardly from the lower portion pair of convex-arcuate-shaped lateral sides 20 of the slightly resilient and generally rectangular-shaped lower portion 16, and with the lower portion legs concave-shaped inboard surfaces 30 of each pair of legs of the lower portion two pair of opposing, generally convexo-concave shaped and vertically-disposed legs 26 of the slightly resilient and generally rectangular-shaped lower portion 16 opposing each other and defining a lower portion longitudinal space 32 therebetween.

A lower portion lateral space 34 is formed between each pair of legs of the lower portion two pair of opposing, generally convexo-concave shaped and vertically-disposed legs 26 of the slightly resilient and generally rectangular-shaped lower portion 16 at the lower portion pair of convex-arcuate-shaped lateral sides 20 of the slightly resilient and generally rectangular-shaped lower portion 16.

The lower portion top surface 24 of the slightly resilient and generally rectangular-shaped lower portion 16 has a lower portion top surface longitudinally-disposed and V-shaped cross-sectioned groove 36 that extends along a longitudinal center line thereof between the lower portion two pair of opposing, generally convexo-concave shaped and vertically-disposed legs 26 of the slightly resilient and generally rectangular-shaped lower portion 16.

The tube squeezer 10 further includes a slightly resilient and generally rectangular-shaped upper portion 38 that has an upper portion pair of longitudinal sides 40, an upper portion pair of lateral sides 42 with centers, and an upper portion bottom surface 44.

The slightly resilient and generally rectangular-shaped upper portion 38 further has an upper portion pair of rectangular-parallelepiped-shaped tabs 46, each of which extends perpendicularly outwardly from the center of a respective lateral side of the upper portion pair of lateral sides 42 of the slightly resilient and generally rectangular-shaped upper portion 38 and releasibly and frictionally engages its respective lower portion lateral space 34 in the slightly resilient and generally rectangular-shaped lower portion 16 when the slightly resilient and generally rectangular-shaped upper portion 38 is interlocked with the slightly resilient and generally rectangular-shaped lower portion 16.

The upper portion bottom surface 44 of the slightly resilient and generally rectangular-shaped upper portion 38 has an upper portion pair of longitudinally-disposed tabs 48, each of which extends downwardly along a respective longitudinal side of the upper portion pair of longitudinal sides 40 of the slightly resilient and generally rectangular-shaped upper portion 38 and releasibly and frictionally engages its respective lower portion longitudinal space 32 in the slightly resilient and generally rectangular-shaped lower portion 16 when the slightly resilient and generally rectangular-shaped upper portion 38 is interlocked with the slightly resilient and generally rectangular-shaped lower portion 16, and terminates in upper portion tab convex-arcuate-shaped ends 50 that releasibly and frictionally engage the lower portion legs concave-shaped inboard surfaces 30 of the lower portion two pair of opposing, generally convexo-concave shaped and vertically-disposed legs 26 of the slightly resilient and generally rectangular-shaped lower portion 16 when the slightly resilient and generally rectangular-shaped upper portion 38 is interlocked with the slightly resilient and generally rectangular-shaped lower portion 16.

The upper portion bottom surface 44 of the slightly resilient and generally rectangular-shaped upper portion 38 further has an upper portion bottom surface longitudinally-disposed and V-shaped cross-sectioned projection 52 that extends along a longitudinal center line thereof between the upper portion pair of longitudinally-disposed tabs 48 on the upper portion bottom surface 44 of the slightly resilient and generally rectangular-shaped upper portion 38, and cooperatively engages the lower portion top surface longitudinally-disposed and V-shaped cross-sectioned groove 36 in the lower portion top surface 24 of the slightly resilient and generally rectangular-shaped lower portion 16 when the slightly resilient and generally rectangular-shaped upper portion 38 is interlocked with the slightly resilient and generally rectangular-shaped lower portion 16, so that when the tube 14 is positioned through the longitudinal spaces 32 in the slightly resilient and generally rectangular-shaped lower portion 16, transversely across the lower portion top surface longitudinally-disposed and V-shaped cross-sectioned groove 36 in the lower portion top surface 24 of the slightly resilient and generally rectangular-shaped lower portion 16, and the upper portion tab convex-arcuate-shaped ends 50 of the upper portion pair of longitudinally-disposed tabs 48 of the upper portion bottom surface 44 of the slightly resilient and generally rectangular-shaped upper portion 38 frictionally engage the lower portion legs concave-shaped inboard surfaces 30 of the lower portion two pair of opposing, generally convexo-concave shaped and vertically-disposed legs 26 of the slightly resilient and generally rectangular-shaped lower portion 16, and the upper portion pair of longitudinally-disposed tabs 48 of the upper portion bottom surface 44 of the slightly resilient and generally rectangular-shaped upper portion 38 frictionally engage the lower portion longitudinal spaces 32 in the slightly resilient and generally rectangular-shaped lower portion 16, and the upper portion pair of rectangular-parallelepiped-shaped tabs 46 of the slightly resilient and generally rectangular-shaped upper portion 38 frictionally engages the lower portion lateral spaces 34 in the slightly resilient and generally rectangular-shaped lower portion 16, the upper portion bottom surface longitudinally-disposed and V-shaped cross-sectioned projection 52 on the upper portion bottom surface 44 of the slightly resilient and generally rectangular-shaped upper portion 38 compresses and deforms the tube 16 downwardly into the lower portion top surface longitudinally-disposed and V-shaped cross-sectioned groove 36 in the lower portion top surface 24 of the slightly resilient and generally rectangular-shaped lower portion 16 where it is maintained and the tube contents 12 in the tube 14 is prevented from flowing backward therefrom.

As shown in FIG. 1, which again is a diagrammatic perspective view of the present invention installed on a typical tube, as the tube contents 12 in the tube 14 is being used, the tube squeezer 10 is slid forwardly along the tube 14, so that the tube contents 12 in the tube 14 is constantly available without waste.

The manner of removing the tube squeezer 10 from the tube 14 when the tube contents 12 in the tube 14 becomes exhausted can best be seen in FIG. 5, which is a diagrammatic perspective view of the present invention being removed from the typical tube, and as such will be discussed with reference thereto.

STEP 1

Insert a screw driver 54 under one tab of the upper portion pair of rectangular-parallelepiped-shaped tabs 46 of the slightly resilient and generally rectangular-shaped upper portion 38.

STEP 2

Twist the screw driver 54.

STEP 3

Pry the one tab of the upper portion pair of rectangular-parallelepiped-shaped tabs 46 of the slightly resilient and generally rectangular-shaped upper portion 38 free of its respective lateral space 34 in the slightly resilient and generally rectangular-shaped lower portion 16.

STEP 4

Cause the upper portion tab convex-arcuate-shaped ends 50 of the upper portion pair of longitudinally-disposed tabs 48 of the slightly resilient and generally rectangular-shaped upper portion 38 to be released from its respective lower portion legs concave-shaped inboard surfaces 30 of the lower portion two pair of opposing, generally convexo-concave shaped and vertically-disposed legs 26 of the slightly resilient and generally rectangular-shaped lower portion 16.

STEP 5

Cause the upper portion pair of longitudinally-disposed tabs 48 of the upper portion bottom surface 44 of the slightly resilient and generally rectangular-shaped upper portion 38 to be released from the lower portion longitudinal spaces 32 in the slightly resilient and generally rectangular-shaped lower portion 16.

STEP 6

Cause another tab of the upper portion pair of rectangular-parallelepiped-shaped tabs 46 of the slightly resilient and generally rectangular-shaped upper portion 38 to be released from its respective lateral space 34 in the slightly resilient and generally rectangular-shaped lower portion 16.

STEP 7

Cause the slightly resilient and generally rectangular-shaped upper portion 38 to become unlocked and separated from the slightly resilient and generally rectangular-shaped lower portion 16.

STEP 8

Remove the tube squeezer 10 from the tube 14.

It will be understood that each of the elements described above, or two or more together, may also find a useful application in other types of constructions differing from the types described above.

While the invention has been illustrated and described as embodied in a tube squeezer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tube squeezer replaceably attachable to a tube with contents and preventing the contents of the tube from flowing backwards therein when the tube is no longer squeezed and thereby allowing the contents of the tube to be readily and constantly available without waste, said squeezer comprising:

a) a lower portion having a pair of longitudinal sides, a pair of lateral sides meeting said pair of longitudinal sides of said lower portion at corners, a top surface, two pair of vertically-disposed legs with outboard surfaces and inboard surfaces; each pair of legs of said two pair of legs of said lower portion extending vertically upwardly from a respective longitudinal side of said pair of longitudinal sides of said lower portion at a respective pair of corners of said corners of said lower portion; said inboard surfaces of each pair of legs of said two pair of legs of said lower portion opposing each other and defining a longitudinal space therebetween; said lower portion further having a lateral space between each pair of legs of said pair of legs of said lower portion at said pair of lateral sides of said lower portion; said top surface of said lower portion having a groove extending longitudinally therealong between said two pair of legs of said lower portion; and b) an upper portion being replaceably interlocked with said lower portion and having a pair of longitudinal sides, a pair of lateral sides with centers, and a bottom surface; said upper portion further having a pair of tabs, each of which extending outwardly from a respective lateral side of said pair of lateral sides of said upper portion and releasibly and frictionally engaging its respective lateral space in said lower portion when said upper portion is interlocked with said lower portion; said bottom surface of said upper portion having a pair of longitudinally-disposed tabs, each of which extending downwardly along a respective longitudinal side of said pair of longitudinal sides of said upper portion and releasibly and frictionally engaging its respective longitudinal space in said lower portion when said upper portion is interlocked with said lower portion, and terminating in ends releasibly and frictionally engaging said inboard surfaces of said two pair of legs of said lower portion when said upper portion is interlocked with said lower portion; said bottom surface of said upper portion further having a projection extending longitudinally therealong between said pair of longitudinally-disposed tabs on said bottom surface of said upper portion, and cooperatively engaging said groove in said top surface of said lower portion when said upper portion is interlocked with said lower portion, so that when the tube is positioned through said longitudinal spaces in said lower portion, transversely across said groove in said top surface of said shaped lower portion, and said ends of said pair of longitudinally-disposed tabs of said bottom surface of said upper portion frictionally engage said inboard surfaces of said two pair of legs of said lower portion, and said pair of longitudinally-disposed tabs of said bottom surface of said upper portion frictionally engage said longitudinal spaces in said lower portion, and said pair of tabs of said upper portion frictionally engage said lateral spaces in said lower portion, said projection on said bottom surface of said upper portion compresses and deforms the tube downwardly into said groove in said top surface of said lower portion where it is maintained and the contents in the tube is prevented from flowing backward therefrom when the tube is no longer squeezed and thereby allowing the contents of the tube to be readily available without waste, and as the contents of the tube is being used, said tube squeezer being slid forwardly along the tube, so that the contents in the tube is constantly available without waste.

2. The squeezer as defined in claim 1, wherein said lower portion is a slightly resilient and generally rectangular-shaped lower portion; said pair of lateral sides of said slightly resilient and generally rectangular-shaped lower portion are a pair of convex-arcuate-shaped lateral sides.

3. The squeezer as defined in claim 1, wherein said two pair of legs of said lower portion are two pair of opposing, generally convexo-concave shaped and vertically-disposed legs; said outboard surfaces of said two pair of opposing, generally convexo-concave shaped and vertically-disposed legs of said lower portion are convex-shaped inboard surfaces; said inboard surfaces of said two pair of opposing, generally convexo-concave shaped and vertically-disposed legs of said lower portion are concave-shaped inboard surfaces.

4. The squeezer as defined in claim 1, wherein said outboard surfaces of said two pair of legs of said lower portion extend smoothly upwardly from said lateral sides of said lower portion.

5. The squeezer as defined in claim 1, wherein said groove in said top surface of said lower portion is a longitudinally-disposed and V-shaped cross-sectioned groove that extends along a longitudinal centerline of said top surface of said lower portion.

6. The squeezer as defined in claim 1, wherein said upper portion is a slightly resilient and generally rectangular-shaped upper portion.

7. The squeezer as defined in claim 1, wherein said pair of tabs of said upper portion is a pair of rectangular-parallelepiped-shaped tabs; each tab of said pair of rectangular-parallelepiped-shaped tabs of said upper portion extends perpendicularly outwardly from said center of said respective lateral side of said pair of lateral sides of said upper portion.

8. The squeezer as defined in claim 1, wherein said ends of said longitudinally-disposed tabs on said bottom surface of said upper portion are convex-arcuate-shaped ends.

9. The squeezer as defined in claim 1, wherein said projection on said bottom surface of said upper portion is a longitudinally-disposed and V-shaped cross-sectioned projection that extends along a longitudinal centerline of said bottom surface of said upper portion.

10. A method of preventing contents of a tube from flowing backwards therein when the tube is no longer squeezed so as to allow the contents of the tube to be readily and constantly available without waste, comprising the step of attaching replaceably the tube in a tube squeezer which comprise:

a) a lower portion having a pair of longitudinal sides, a pair of lateral sides meeting said pair of longitudinal sides of said lower portion at corners, a top surface, two pair of vertically-disposed legs with outboard surfaces and inboard surfaces; each pair of legs of said two pair of legs of said lower portion extending vertically upwardly from a respective longitudinal side of said pair of longitudinal sides of said lower portion at a respective pair of corners of said corners of said lower portion; said inboard surfaces of each pair of legs of said two pair of legs of said lower portion opposing each other and defining a longitudinal space therebetween; said lower portion further having a lateral space between each pair of legs of said pair of legs of said lower portion at said pair of lateral sides of said lower portion; said top surface of said lower portion having a groove extending longitudinally therealong between said two pair of legs of said lower portion; and b) an upper portion being replaceably interlocked with said lower portion and having a pair of longitudinal sides, a pair of lateral sides with centers, and a bottom surface; said upper portion further having a pair of tabs, each of which extending outwardly from a respective lateral side of said pair of lateral sides of said upper portion and releasibly and frictionally engaging its respective lateral space in said lower portion when said upper portion is interlocked with said lower portion; said bottom surface of said upper portion having a pair of longitudinally-disposed tabs, each of which extending downwardly along a respective longitudinal side of said pair of longitudinal sides of said upper portion and releasibly and frictionally engaging its respective longitudinal space in said lower portion when said upper portion is interlocked with said lower portion, and terminating in ends releasibly and frictionally engaging said inboard surfaces of said two pair of legs of said lower portion when said upper portion is interlocked with said lower portion; said bottom surface of said upper portion further having a projection extending longitudinally therealong between said pair of longitudinally-disposed tabs on said bottom surface of said upper portion, and cooperatively engaging said groove in said top surface of said lower portion when said upper portion is interlocked with said lower portion, so that when the tube is positioned through said longitudinal spaces in said lower portion, transversely across said groove in said top surface of said shaped lower portion, and said ends of said pair of longitudinally-disposed tabs of said bottom surface of said upper portion frictionally engage said inboard surfaces of said two pair of legs of said lower portion, and said pair of longitudinally-disposed tabs of said bottom surface of said upper portion frictionally engage said longitudinal spaces in said lower portion, and said pair of tabs of said upper portion frictionally engage said lateral spaces in said lower portion, said projection on said bottom surface of said upper portion compresses and deforms the tube downwardly into said groove in said top surface of said lower portion where it is maintained and the contents in the tube is prevented from flowing backward therefrom when the tube is no longer squeezed and thereby allowing the contents of the tube to be readily available without waste, and as the contents of the tube is being used, said tube squeezer being slid forwardly along the tube, so that the contents in the tube is constantly available without waste.

11. The method as defined in claim 10, wherein said lower portion is a slightly resilient and generally rectangular-shaped lower portion; said pair of lateral sides of said slightly resilient and generally rectangular-shaped lower portion are a pair of convex-arcuate-shaped lateral sides.

12. The method as defined in claim 10, wherein said two pair of legs of said lower portion are two pair of opposing, generally convexo-concave shaped and vertically-disposed legs; said outboard surfaces of said two pair of opposing, generally convexo-concave shaped and vertically-disposed legs of said lower portion are convex-shaped inboard surfaces; said inboard surfaces of said two pair of opposing, generally convexo-concave shaped and vertically-disposed legs of said lower portion are concave-shaped inboard surfaces.

13. The method as defined in claim 10, wherein said outboard surfaces of said two pair of legs of said lower portion extend smoothly upwardly from said lateral sides of said lower portion.

14. The method as defined in claim 10, wherein said groove in said top surface of said lower portion is a longitudinally-disposed and V-shaped cross-sectioned groove that extends along a longitudinal centerline of said top surface of said lower portion.

15. The method as defined in claim 10, wherein said upper portion is a slightly resilient and generally rectangular-shaped upper portion.

16. The method as defined in claim 10, wherein said pair of tabs of said upper portion is a pair of rectangular-parallelepiped-shaped tabs; each tab of said pair of rectangular-parallelepiped-shaped tabs of said upper portion extends perpendicularly outwardly from said center of said respective lateral side of said pair of lateral sides of said upper portion.

17. The method as defined in claim 10, wherein said ends of said longitudinally-disposed tabs on said bottom surface of said upper portion are convex-arcuate-shaped ends.

18. The method as defined in claim 10, wherein said projection on said bottom surface of said upper portion is a longitudinally-disposed and V-shaped cross-sectioned projection that extends along a longitudinal centerline of said bottom surface of said upper portion.

19. A method of removing a tube squeezer from a tube it is engaged with, comprising the steps of:

a) inserting a screw driver under one tab of a pair of rectangular-parallelepiped-shaped tabs extending outwardly from opposite lateral sides of a slightly resilient and generally rectangular-shaped upper portion of said tube squeezer;

b) twisting said screw driver;

c) prying said one tab of said pair of rectangular-parallelepiped-shaped tabs of said slightly resilient and generally rectangular-shaped upper portion free of its respective lateral space in a slightly resilient and generally rectangular-shaped lower portion of said tube squeezer;

d) causing convex-arcuate-shaped ends of a pair of longitudinal tabs of a bottom surface of said slightly resilient and generally rectangular-shaped upper portion to be released from their respective concave-shaped inboard surfaces of two pair of opposing, generally convexo-concave shaped and vertically-disposed legs extending vertically upwardly from said slightly resilient and generally rectangular-shaped lower portion;

e) causing said pair of longitudinally-disposed tabs of said bottom surface of said slightly resilient and generally rectangular-shaped upper portion to be released from their respective longitudinal spaces in said slightly resilient and generally rectangular-shaped lower portion;

f) causing another tab of said pair of rectangular-parallelepiped-shaped tabs of said slightly resilient and generally rectangular-shaped upper portion to be released from its respective lateral space in said slightly resilient and generally rectangular-shaped lower portion;

g) causing said slightly resilient and generally rectangular-shaped upper portion to become unlocked and separated from said slightly resilient and generally rectangular-shaped lower portion; and h) removing said tube squeezer from the tube.

* * * * *